US005311680A

United States Patent [19]

Comparetto

[11] Patent Number: 5,311,680

[45] Date of Patent: May 17, 1994

[54] DYNAMIC ORTHOTIC

[76] Inventor: John E. Comparetto, 4953 Nighthawk Dr., Cincinnati, Ohio 45247

[21] Appl. No.: 788,838

[22] Filed: Nov. 7, 1991

[51] Int. Cl.[5] ..... A43B 7/14

[52] U.S. Cl. ..... 36/154; 36/43; 36/140; 36/145; 36/153; 36/151

[58] Field of Search ..... 36/43, 44, 71, 140, 36/145, 151, 152, 153, 154, 167, 168, 182

[56] References Cited

U.S. PATENT DOCUMENTS

| | | | |
|---|---|---|---|
| 1,704,187 | 3/1929 | Glidden et al. | 36/44 |
| 1,814,514 | 7/1931 | Karlson | 36/182 |
| 3,244,177 | 4/1966 | Scholl | 36/154 |
| 3,999,558 | 12/1976 | Barnwell et al. | 36/145 |
| 4,020,570 | 5/1977 | Shames | 36/44 |
| 4,271,606 | 6/1981 | Rudy | 36/29 |
| 4,423,735 | 1/1984 | Comparetto | 36/153 |
| 4,441,499 | 4/1984 | Comparetto | 36/154 |
| 4,522,777 | 6/1985 | Peterson | 36/154 |
| 4,597,196 | 7/1986 | Brown | 36/44 |
| 4,628,936 | 12/1986 | Langer et al. | 36/43 |

*Primary Examiner*—Steven N. Meyers
*Assistant Examiner*—M. D. Patterson
*Attorney, Agent, or Firm*—Wood, Herron & Evans

[57] ABSTRACT

A foot supporting orthotic having parallel, separately flexing rays extending forwardly from an arch region which in use underlies the arch of a wearer's foot. The rays are bowed by spring-like elastomers and facilitate the shock absorbing and adaptation stages of walking.

6 Claims, 3 Drawing Sheets

DYNAMIC ORTHOTIC

BACKGROUND OF THE INVENTION

The present invention is an improvement upon the subject matter of my U.S. Pat. No. 4,441,499, issued Apr. 10, 1984. That patent discloses a dynamic foot support or "orthotic" platform which helps the foot move through various critical positions or stages within the walking cycle. The dynamic platform facilitates the shock absorbing and adaption stage of the gait cycle which is called "pronation." Pronation occurs during heel contact until the midstance, full weight bearing stage of the human gait. During the human gait an eversion of the heel occurs in the subtalar joint (that is, the heel bone) and in the bone directly above it (the talus). As pronation occurs, the midtarsal joint becomes more easily "unlocked." (The midtarsal joint is comprised of the composite calcaneal cuboid and talar navicular joint). This unlocking or free swinging attitude gives the foot its adaptability and enhances its ability to absorb shock. However, if pronation continues beyond midstance the foot becomes inefficient for thrust off. As a result the forefoot becomes hypermobile at all its joints and therefore more susceptible to all the wear and tear conditions and acquired deformities associated with mechanical foot disorders. The motion that is opposite to pronation, i.e., suppination or inversion of the feet, causes the axis of the articulation (calcaneal-cuboid, talarnavicular) to become oblique making the midtarsal joint lock up, which in turn makes the foot a rigid lever for thrust off.

Many of the prescribed or over-the-counter orthotics attempt to limit or eliminate the natural pronation. The orthotic of the '499 patent facilitates pronation by assisting the foot in moving from pronation toward the position of suppination that is necessary to attain efficient toe off for forward propulsion, and thereby reduces the hypermobility of the forefoot. The '499 patent discloses a platform having longitudinal cuts which form finger-like portions which are referred to as "rays." (The foot also has rays which consist of each metatarsal and its articulation with its corresponding cuneiform bone, with the exception of the fourth and fifth metatarsals which articulate with the cuboid.) The rays of the platform are cut far into the platform, from the toe or leading end of the platform all the way to the heel. The platform rays disclosed in the '499 patent extend past the ends of the rays of the actual foot and in fact past the midtarsal joint articulations.

SUMMARY OF THE INVENTION

I have found that the rays as disclosed in the '499 patent have a number of undesirable effects. The platform disclosed in that patent bows beyond the normal confines of the foot's anatomical longitudinal arch, which has been found to cause discomfort in the heel. Equally important, the midtarsus which includes the midtarsal joint is relatively unsupported at the midstance phase of gait. In accordance with the present invention, the rays extend rearwardly only to the arch region beneath the midtarsal joint, and end substantially forward of the heel. This keeps the midfoot supported and causes the platform to better conform to the natural longitudinal arch of the foot.

This invention is further concerned with several variations of elastomeric fixation, variance of ray configurations for both normal and abnormal biomechanics and anatomy of the foot, and variations in elastomer and methods of fabrication. The objects of this invention are to provide more efficient methods of manufacture, including easier methods of assembly. These objects also include providing more durable elastomers and embodiments which may be incorporated into a shoe or sandal.

DETAILED DESCRIPTION

Figure 1:
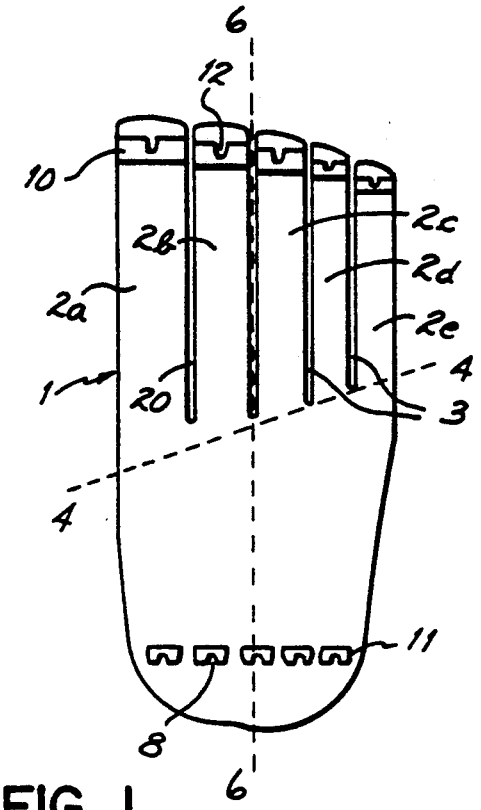
FIG. 1 is a bottom plan view of a preferred form of orthotic platform according to the invention, showing attachment areas for elastic bands.

FIG. 1 shows an orthotic platform in accordance with the present invention, having five rays or fingers *2a*, *2b*, *2c*, *2d*, and *2e*, each separated by a slot 3, of gradually decreasing lengths from the big toe side to the little toe side. The overall length of the platform corresponds generally to that of the foot. In contradistinction to the '499 patent the slots (and hence the ray lengths) are much shorter, extending rearwardly only to the area of the midtarsal joint of the wearer's foot as indicated by dotted line 4—4; they do not extend to the heel area. The shorter slot length improves the bowing of the rays when under flexion, so as to better control the overall curvature of the arch and the flexible response and orthotic elongation in response to the movement of the foot in gait.

The lengths of the rays preferably differ incrementally. Too great a difference between the lengths of consecutive slots can cause a twist in the ray toward the longer slot. The difference should be kept small, for example, no more than 3/16" for a large orthotic and correspondingly smaller for a smaller orthotic. The inner ends of the slots 3 preferably form a line 4—4 extending at an angle of about 70° to 72° to the long axis 6—6 of the orthotic, although this may vary with the flexural characteristics of the platform and the elastomer. The longer the slots are, the greater the flexure in the curve of the orthotic and the higher the longitudinal arch. Longer slots also cause less rigidity and support. (In use, the left side of the orthotics shown in FIG. 1 will underlie the first metatarsal.)

Figure 8:
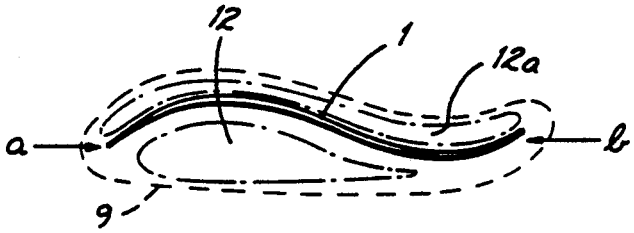
FIG. 8 is a diagrammatic longitudinal cross-sectional view of a platform encapsulated in an elastomer, in accordance with a preferred embodiment of the invention.

In FIG. 8 a platform 1 is shown encapsulated in an elastic 9 such as rubber. The platform is compressed longitudinally or endwise, within the limits of its elasticity. The platform is held compressed in the direction of arrows a and b during application and curing of the elastic. This automatically puts the cured elastomer under dynamic tension once the compression forces are released. The encapsulating substance 9 can cover the entire platform, preferably with a relative thin layer on the top surface and a thicker layer below. Optionally, elastic 9 can have an internal hollow area 12 or it can be solid through the lower surface of the platform. The hollow area 12 may be such that only a thin membrane of elastomer connects the upper coating with the tensed undersurface of the platform, thereby providing a partition to separate the rays and keep them from rubbing together as they are stretched through their separate up and down motions.

Figure 9:
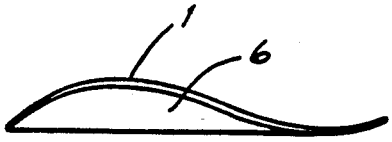
FIG. 9 is a diagrammatic side view of a platform having a foam elastomer beneath it.

FIG. 9 shows a platform 1 having a resilient foam 6 on its undersurface only. This embodiment could be made with or without compression of the platform during curing. The foam could also be affixed separately to the platform, as by adhesive. There is a greater dynamism with a foam elastomer that is under tension. A resilient but elastically passive foam could be used but would not have as much shock absorption or range of motion characteristics. An example of an elastic foam would be a rubber foam that can be both compressed and stretched. With these properties the elastomer would absorb shock and return to its original shape. A passive foam can be resilient (with a memory to retain its original shape) but have little or no elastic stretch property and therefore be unable to elongate without rupture. An orthotic made of such a resilient foam would not have a wide range of motion but would allow the orthotic rays to impress upon the foam as dictated by the foot rays above them. This embodiment of the orthotic thus could be employed in cases where a limited range of motion is desired, as in severe arthritis or in post injury situations.

Normally a five ray orthotic with independently movable rays is uniquely comfortable. There are however certain cases wherein independent movement of the anatomical foot rays causes pain. Severe arthritis and post surgical conditions are examples of this; another specific example would be where Morton's neuroma is present. The neuroma is a benign tumor of nerve tissue that most commonly forms in the space between the heads of the metatarsal bones. Reduction of the independent movement of the metatarsal bone heads is helpful during therapy and reduces patient discomfort. By eliminating the longitudinal slot 3 defining the edge of two adjacent rays in the orthotic, two rays coalesce into one; the effect of merging two adjacent foot rays is like splinting. The remaining rays would work in their full range. If an area of neuroma formation lies between the third and fourth metatarsal head, for example, then slot number 20 in FIG. 1 would be eliminated and the orthotic would have only four rays.

The foot has been described as being separated into two metatarsal segments comprised of the first and second metatarsals and then the third, fourth, and fifth metatarsals. It is thought that the first two metatarsals work together while the last three also work as an individual unit. A dynamic orthotic having only one metatarsal slot, defining two segments of the above described metatarsal units, could have utility for specific applications. One ray would support the first two metatarsals and a second ray, separated from the first by a longitudinal slot, would support the third, fourth, and fifth metatarsals.

Figure 11:
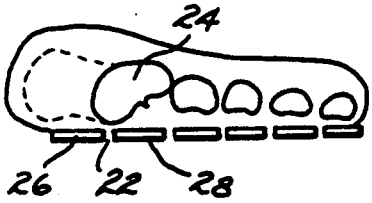
FIG. 11 is a diagrammatic transverse cross-sectional view through the he metatarsal head of a foot on a platform with an additional orthotic ray.

In some instances more than five rays may be needed, for example in the case of supernumary bones, or where there is axial rotation of the first metatarsal, as in severe cases of hallux abductovalgus. The additional orthotic ray would add comfort in only very specific cases, such as those identified. FIG. 11 illustrates an orthotic having an extra longitudinal slot 22 lying directly below the planar-most edge of the rotated metatarsal 24. Slot 22 splits the first ray into two smaller rays 26 and 28. Each smaller ray supports the first metatarsal but at areas immediately to the side of this most prominent plantar bony projection.

Figure 4:
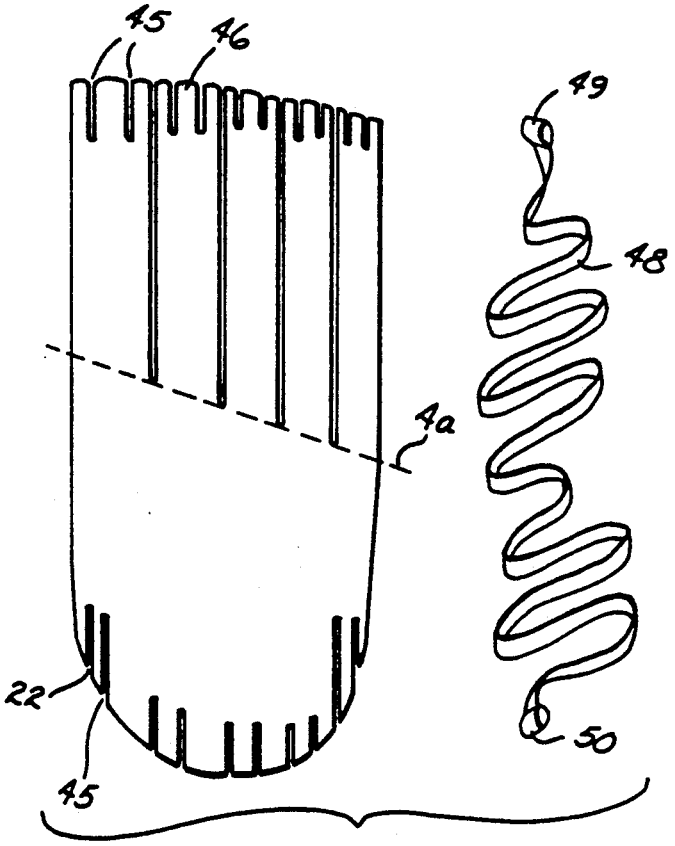
FIG. 4 is a top plan view of a modified platform of the present invention.
Figure 5:
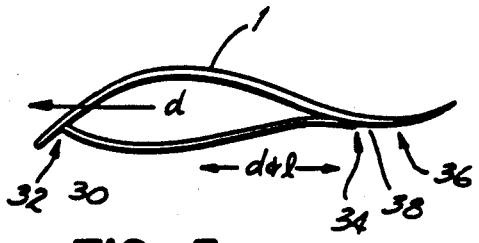
FIGS. 5, 6, and 7 are side views of alternative embodiments of platforms with different types of biasing means.
Figure 6:
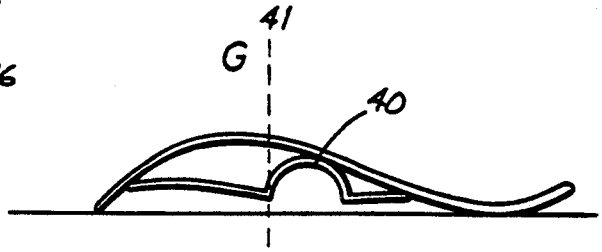
Figure 7:
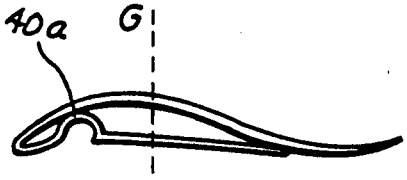

Other embodiments of the invention are seen in FIGS. 5, 6, and 7. In FIG. 5, the dynamic platform 1 has a leaf spring member 30 which makes contact with the platform in either a fixed or movably cooperative way (such as a slot or tongue and groove configuration) at its ends 32 and 34. Elongation of the spring can occur at either or both ends 32 and 34. This leaf spring 30 is upwardly concave, that is, its concavity faces the platform. Under load the leaf spring flexes in the direction of the concavity of the undersurface of platform 1 while elongating with the platform under load, in the direction depicted by arrow d. The leaf spring may have individual struts below the respective rays 2; and the limits of its articulation are designated by 38 and 36 at the heel of the platform. In the case of limit 34 the spring can elongate in directions d and e represented by the double arrow in FIG. 5. Limit 36 however is a weight bearing area and is therefore stationary during elongation so that the leaf spring moves only in direction d. FIG. 6 shows a leaf spring member that has a central dome 40 that abuts the concavity of the dynamic platform at an area across and behind the inner ends of the slots 3 at the plane indicated by broken line 41, which corresponds to the general area of dotted line 4 (FIG. 1) and 4*a* (FIG. 4). FIG. 7 shows a leaf spring that abuts or articulates in five separate domes 40*a* below the five respective rays.

Figure 2:
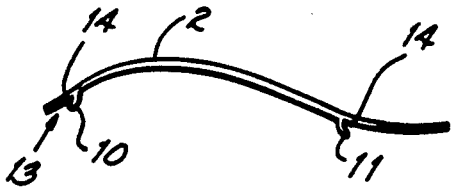
FIG. 2 is a side view of a platform having elastic band attachment areas.
Figure 3:
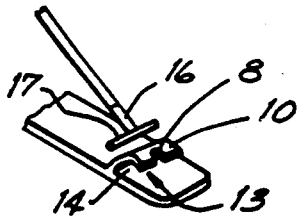
FIG. 3 is an enlarged diagrammatic perspective view of one embodiment of an attachment area.
Figure 10:
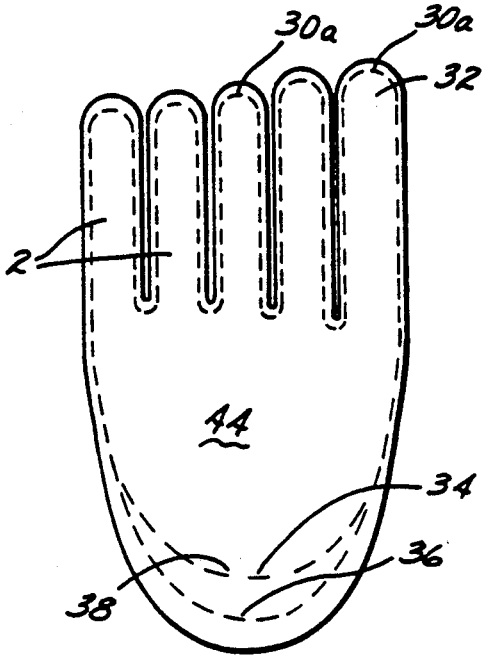
FIG. 10 is a bottom plan view of another embodiment of the platform.

FIG. 10 illustrates another type of platform, having an underlying elastomeric sheet 44 that is essentially shaped like a hand with fingers and a palm. Sheet 44 is stretched and attached by suitable means to the underside of the platform. One suitable attaching means is depicted in FIGS. 1, 2 and 3, and comprises downward hook-like projections 10 on each ray 2 and similar projections 11 in the heel region. Each projection 10 has open end 13 which is confluent with a channel 14. Within the body of the projection 10 is a notch 8. The elastomeric member 44 has a cross piece 17 at its end 16. The cross piece 17 is received in the open end 13 while under tension with end 16 within notch 8. This assembly allows for easy elastomeric attachment and replacement.

A preferable, easy to manufacture and assemble embodiment of the invention is shown in FIG. 4. On the distal (toe) end of each ray, and at suitable positions along the proximal (rear) border of the heel are slits 44 which are easily machined or injection molded. There are various methods of utilizing these slots to hold an elastomer band 48 under tension between the opposite ends of the platform. For example, elastomeric bands such as common rubber bands can be attached by looping an end over a ray post 46 between two adjacent slits 45, and stretching the band so that the other end can be looped over a heel post. Another and preferred method is to use the long single elastomeric band 48 that has loops 49 and 50 at its ends. The loop 49 at one end is hooked over a post, for example the post of the fifth ray (corresponding to the fifth or smallest metatarsal), and the band is "woven" into each slot from post to post, rearward and again forward, back and forth until the other end loop 50 is placed over the slots and post of the first ray under tension. This configuration offers both amplitude and flexion to the arch and tension to the elastomer.

Figure 12:
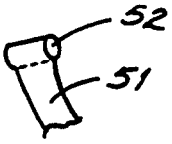
FIGS. 12, 13, and 14 are diagrammatic views illustrating various elastomeric means for securing bands to the platform.
Figure 13:
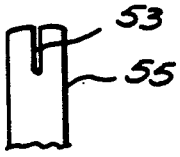
Figure 14:
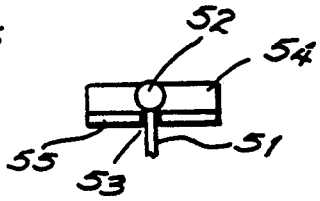

Another embodiment of an attachment means is depicted in FIGS. 12, 13, and 14. Elastomer band 51 is hooked back upon itself at both ends around a plug 52 by which it can be locked in a slot 53 positioned on each ray and heel region. The band 51 slips easily into the slot and is pulled taut so that the plug nestles into a cushioned layer 54 so that it is flush with the foot surface of the orthotic yet at the same time cannot pass through slot 53 in ray 55. The opposite end is stretched and placed in a corresponding heel slot. Cushioning layer 54, which may be made of foam or other suitable inner sole type material, is an optional covering to enhance the presentation of the orthotic, and it also functions to relieve the irregularity and smooths the weight bearing surface of the orthotic that would otherwise be caused by the rolled or thickened end. This simple to fabricate roll-end band could also be weaved through multiple slots as in the embodiment of the previous example to add strength as needed in heavier individuals. Multiple passages of the band could be made through the same slot provided the slot is made bigger to accommodate multiple passages or elastomeric bands of greater thickness.

The dynamic platform orthotic can be attached to a sandal. The slotted heel region may be attached to the sandal by any suitable means such as rivets or adhesives, can be eliminated (so that the orthotic ends just in front of the heel), or it can be embedded within a sandal sole of suitable thickness. The sandal could have straps attached directly to the orthotic or laminated between layers of sole material.

In the beginning of this application a dynamic platform orthotic which is encapsulated in elastomer was described. Also described was an elastomer in a hand-shaped configuration with finger-like projections corresponding to each ray. These finger-like projection means can be separate pieces attached to the platform, or they can be unitary, in the form of a glove. The bottom side of the glove carries out the tensing function for the platform to withstand, in conjunction with the platform, the loading and unloading of the wearer's weight. Referring again to FIG. 8, the uppermost portion of this glove can have molded upper internal chamber 12*a* that is in the general shape of the orthotic upper surface complete with chamber extension above each ray. This last feature differs from that shown in my earlier U.S. Pat. No. 4,423,735 which had a chamber that was not segregated into individual ray members. The chambers can be filled with a fluid or gel to cushion and enhance the dynamic platform, in a similar way as described in the previously identified patents. The upper chamber 12*a* can be limited to the immediate vicinity of the underlying platform, or could be extended upward by appropriate molding to form the upper portion of the inner sole of a shoe. Such a shoe sole of the present invention has the comfort advantage of fluidity that generally conforms to the shape of the wearer's foot. The underside that contains the stretched elastomer preferably sits slightly above the lower inner sole of the shoe or sandal so that it goes through the movement of elongation and contraction with the platform unimpeded. The elastomeric portion can actually strike the ground and elongate but it is preferable from the standpoint of ease of movement and wear, that a shoe insert be provided that relieves the elastomeric portion from such extra duty.

Having described the invention, what is claimed is:

1. A spring platform for supporting the human foot through various stages of gait comprising:

a base having a proximal end for underlying the heel of a wearer up to an area corresponding to a midtarsal joint of the wearer and a distal end for underlying the toes back to the midtarsal joint area of the wearer, said distal end having a plurality of separated rays joined to said proximal end, each said ray separated from an adjacent ray by a longitudinal slot and terminating at a position underlying the midtarsal joint area, each said slot being substantially progressively longer from a first metatarsal side to a fifth metatarsal side of said platform such that a line joining a proximal end of each said ray is acutely angulated with respect to a longitudinal axis of said platform.

2. The platform of claim 1, wherein each said rays have a degree of flexion which in use permits the ray to flexibly respond in a bowed configuration to the cant of the portion of the arch of the foot of a wearer overlying each said ray.

3. An orthotic apparatus comprising:

an elastomer base; and a flexible platform conforming to the plantar surface of the human foot, said platform being in longitudinal compression and embedded in said elastomer base, a portion of said elastomer base underlying said platform and being in tension due to force exerted on the underlying portion of said elastomer base by said platform embedded therein, said underlying portion positioned between said platform and an innersole of a shoe of the wearer, said platform having a heel, an arch region and a plurality of rays beginning in the arch region, said rays positioned to underlie the respective rays of the human foot, said arch region supporting both the midtarsal joint and the subtalar joint.

4. The apparatus of claim 3 wherein a second portion of said elastomer base overlies said platform and substantially covers an upper surface of the platform including said rays, said second portion of said elastomer base positioned to lie between said platform and the foot of a wearer.

5. The orthotic apparatus of claim 4 further comprising:

a plurality of hollow chambers in the overlying portion of said elastomer base, each said chamber overlaying each said ray, and each said chamber being filled with a fluid.

6. The orthotic apparatus of claim 3, wherein said elastomer base is a foam elastomer.

* * * * *